US006638025B2

(12) United States Patent
Blass et al.

(10) Patent No.: US 6,638,025 B2
(45) Date of Patent: Oct. 28, 2003

(54) METHOD AND APPARATUS FOR CONTROLLING A FLUID ACTUATED SYSTEM

(75) Inventors: James R. Blass, Bloomington, IL (US); Dennis H. Gibson, Chillicothe, IL (US); Ryan P. Michels, Peoria, IL (US)

(73) Assignee: Caterpillar Inc, Peoria, IL (US)

( * ) Notice: Subject to any disclaimer, the term of this patent is extended or adjusted under 35 U.S.C. 154(b) by 12 days.

(21) Appl. No.: 10/020,145

(22) Filed: Dec. 14, 2001

(65) Prior Publication Data

US 2003/0113210 A1 Jun. 19, 2003

(51) Int. Cl.[7] ..... F04B 49/00
(52) U.S. Cl. ..... 417/212; 417/53; 123/446
(58) Field of Search ..... 417/212, 284, 417/283, 269, 440, 53; 123/381, 446, 447, 456, 458, 506; 73/54.31

(56) References Cited

U.S. PATENT DOCUMENTS 4,381,750 A * 5/1983 Funada ..... 123/446
4,711,216 A * 12/1987 Takeuchi et al. ..... 123/447
4,934,143 A 6/1990 Ezell et al.
5,121,730 A * 6/1992 Ausman et al. ..... 123/467
5,305,681 A * 4/1994 Devier et al. ..... 91/361
5,357,912 A * 10/1994 Barnes et al. ..... 123/357
5,423,302 A * 6/1995 Glassey ..... 123/446
5,485,820 A * 1/1996 Iwaszkiewicz ..... 123/458
5,515,829 A * 5/1996 Wear et al. ..... 123/446
5,740,782 A * 4/1998 Lowi ..... 123/446
6,035,828 A * 3/2000 Anderson et al. ..... 123/446
6,227,167 B1 5/2001 Smith et al.
6,267,561 B1 7/2001 Sommars
6,497,223 B1 * 12/2002 Tuken et al. ..... 123/497

* cited by examiner

*Primary Examiner*—Charles G. Freay
*Assistant Examiner*—Han L Liu
(74) *Attorney, Agent, or Firm*—Tom Derry

(57) ABSTRACT

The present invention relates to an improved fluid actuated system, such as those used in hydraulically actuated fuel injectors of an internal combustion engine. A fluid pump supplies hydraulic fluid to a high pressure rail that in turn supplies the fuel injectors with high pressure fluid. Pump output control is provided by an actuator and an electronic control module. A position sensor provides data related to actuator position to the electronic control module. Pump control parameters are determined by the electronic control module, based on fluid pressure, engine operating conditions and actuator position.

16 Claims, 2 Drawing Sheets

METHOD AND APPARATUS FOR CONTROLLING A FLUID ACTUATED SYSTEM

TECHNICAL FIELD

The present invention relates generally to a hydraulically-actuated system, and more specifically to a fluid pump having a position sensor adapted to sense actuator position.

BACKGROUND

U.S. Pat. No. 6,035,828 to Anderson et al. describes a system having a variable delivery fluid pump. In this system the pump supplies fluid to a hydraulically-actuated fuel injection system. The pump outlet supplies high pressure lubrication oil to a plurality of hydraulically-actuated fuel injectors of a diesel engine. The pump is driven directly by the engine, and pump output is varied by an electronically controlled actuator. A pressure sensor is provided in the system that monitors the actual fluid pressure within the system. An electronic control module monitors fluid pressure and a number of engine operating parameters to determine if actual fluid pressure is sufficient for current engine operating conditions. To minimize the output of emissions of the engine, precise control of fluid pressure is critical.

If actual pressure is below a predetermined desired pressure the controller calls for higher pump output. As desired pressure is reduced the pump output is reduced. Because control strategy is based on pressure data only, the controller must estimate how far to move the actuator in a given direction.

Monitoring and controlling pump output based on actual pressure typically works well, although occasions arise that reduce the effectiveness of this control method. One such example, the viscosity of lubrication oil varies due to oil temperature and condition. The variability of fluid viscosity, in turn, varies the speed that the actuator moves. Movement of the actuator directly relates to pump control.

In some cases the pump may overshoot or undershoot desired system pressure. Even very small differences in actual pressure and desired pressure can adversely impact emissions and engine efficiency.

The present invention is directed to overcoming one or more of the above identified problems.

SUMMARY OF THE INVENTION

In one aspect of the present invention a fluid actuated system is provided. The fluid actuated system includes a variable delivery pump having a piston and a high pressure conduit. An actuator having a plunger and a position sensor adapted to deliver a position signal are connected to the pump. A fluid pressure sensor is connected to the high pressure outlet and adapted to deliver a signal related to a fluid pressure. An electronic control module is adapted to receive the pressure and position signals and send a directional control signal.

In another aspect of the invention a method of controlling a fluid pump is provided. The method includes the steps of sensing the pressure fluid in a high pressure conduit, sensing the position of an actuator and delivering a position related signal and delivering a directional move signal in response to the pressure signal and the position signal.

In yet another aspect of the present invention a method of estimating the viscosity of a fluid in a hydraulically actuated system is provided. The method includes the steps of sensing a first position of a moveable device within the system, delivering a directional move signal to the moveable device and sensing a second position of the moveable device, calculating a speed of said moveable device and calculating the viscosity of the fluid.

DETAILED DESCRIPTION

Figure 1:
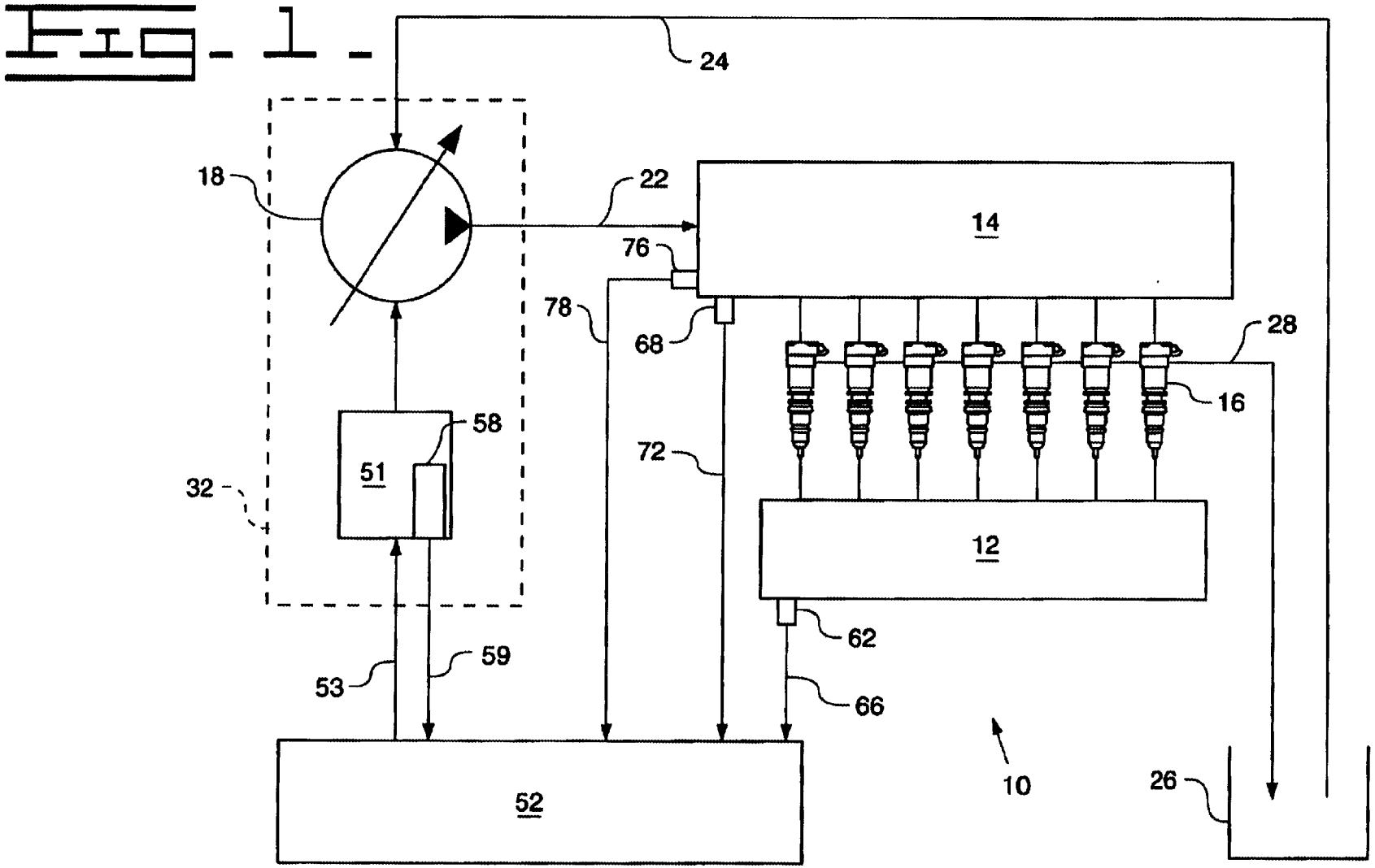
FIG. 1 is a schematic illustration of a hydraulically-actuated system according to the present invention.

Referring now to FIG. 1, a hydraulically actuated system 10 is attached to an internal combustion engine 12. The hydraulically actuated system 10 includes a high pressure rail 14 that supplies high pressure actuation fluid to a plurality of hydraulically-actuated devices, such as hydraulically actuated fuel injectors 16. Those skilled in the art will appreciate that other hydraulically actuated devices, such as actuators for gas exchange valves or exhaust brakes, could be substituted for the fuel injectors 16 illustrated in the example embodiment. The high pressure rail 14 is pressurized by a variable output fluid pump 18 via a high pressure supply conduit 22. The pump 18 draws actuation fluid along a low pressure supply conduit 24 from a source of low pressure fluid, preferably the engine's lubricating oil sump 26. Although other available liquids could be used, the present invention preferably uses engine lubrication oil as its hydraulic medium. After the high pressure fluid does work in the individual fuel injectors 16, the actuating fluid is returned to sump 26 via drain passage 28.

Typical variable delivery pumps include a pump housing 32 and a rotating shaft 34 positioned within the housing 32. The rotating shaft 34 is coupled to the engine 12, such that rotation of the engine 12 crank shaft (not shown) causes rotation of the pump shaft 34. An angled swash plate 36 is attached to the rotating shaft 34 and causes a plurality of parallel disposed pistons 38 to reciprocate in a first direction d1 and a second direction d2, opposite the first direction d1. In this example, the pump 18 includes five pistons 38 that are urged in the first direction d1, (toward the swash plate 36) by return springs 42. Each piston 38 includes a shoe 44 that maintains contact with the swash plate 36. As the piston 38 moves in the first direction d1, fluid is drawn from a low pressure portion 46 of the housing 32 into a piston cavity 48. As the piston 38 moves in the second direction d2, fluid is pushed from the piston cavity 48, past a check valve 50 and into the high pressure supply conduit 22. Fluid pressure in the high pressure rail 14 is controlled by an actuator 51 that is controlled by an electronic control module 52. An electrical control line 53 provides communication between the actuator 51 and the electronic control module 52.

Figure 2:
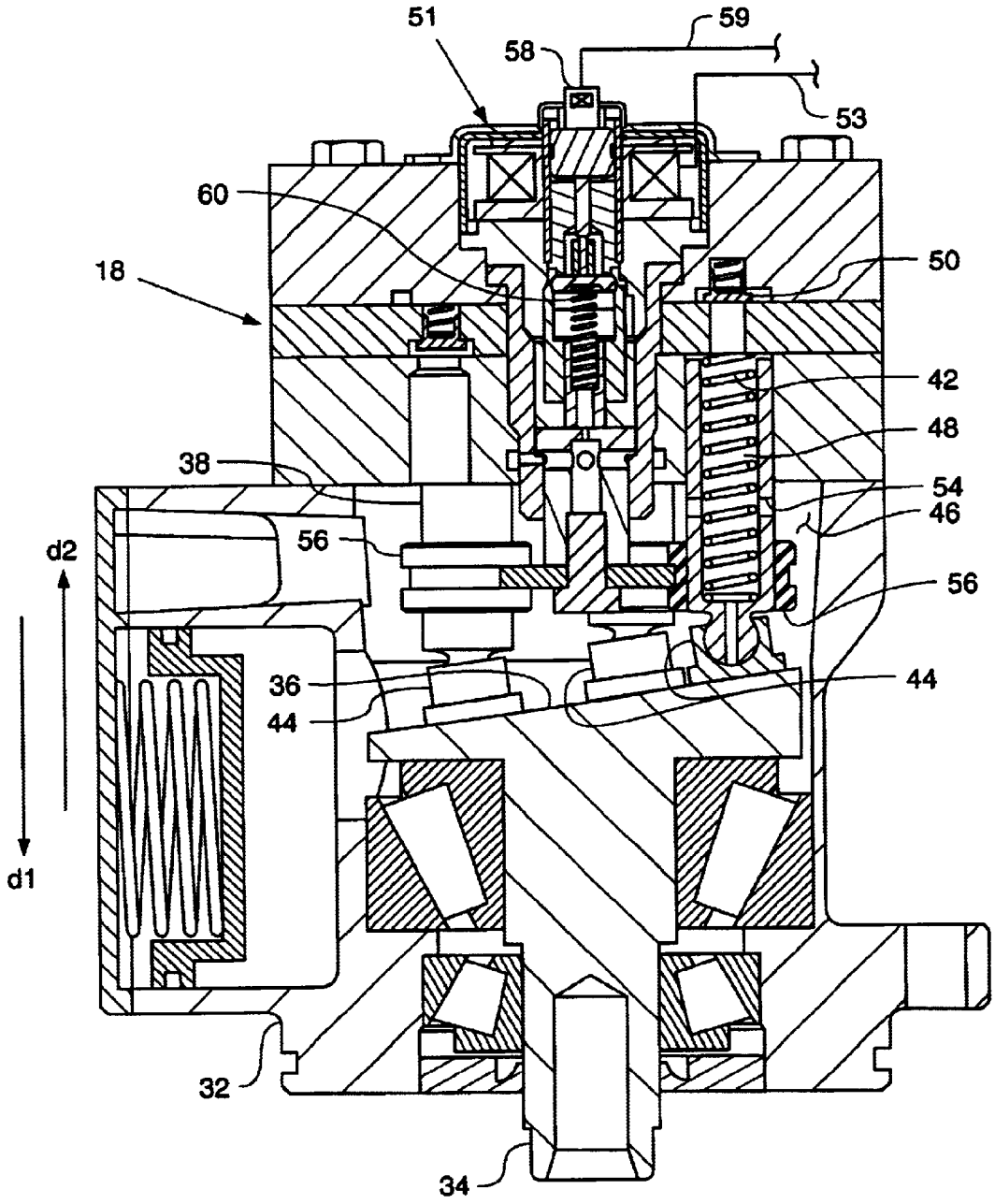
FIG. 2 is a sectioned side diagrammatic view of a fixed displacement variable delivery pump according to one aspect of the present invention.

Although the invention may be applied to a variety of fluid pumps, a fixed displacement variable delivery pump and a variable displacement pump will be discussed in detail. The fixed displacement variable delivery pump 18 is illustrated in FIG. 2. The fixed displacement variable delivery pump 18 includes a fixed angle swash plate 36 rotatably disposed within the pump housing 32. Each piston 38 includes a spill port 54 extending from the piston cavity 48 to the low pressure portion 46 of the pump 18. A sleeve 56 is slidably positioned over each piston 38 and coupled to the actuator 51. The actuator 51 is moveable between a first position and a second position. The first position being related to fluid output at maximum, and the second position being related to fluid output minimum. The actuator 51 being in the second position, the spill ports 54 are uncovered, movement of the piston 38 in the second direction d2 causes fluid to spill back into the low pressure portion 46 of the pump 18. The actuator 51 being in the first position, the spill ports 54 are covered, movement of the piston in the second direction d2, causes fluid to be pushed out of the piston cavity 48 past a check valve 50 and into the high pressure rail 14.

The variable displacement pump (not shown), is similar to the fixed displacement variable delivery pump, but uses a variable angle swash plate 36 to control fluid output. The variable angle swash plate 36 pivots about a central axis and is connected to the actuator 51. The actuator 51 is connected is controlled by the electronic control module 52 to change the swash plate 36 angle. The swash plate 36 angle, in turn controls the distance that each piston 38 moves. Reducing the distance reduces pump 18 output and increasing the distance increases pump 18 output.

The actuator 51 may be of typical construction, including hydraulic, electronic, or electro-hydraulic as illustrated in FIG. 2. A position sensor 58 is disposed on or near the actuator 51. The position sensor 58 is adapted to sense the distance of the actuator 51 from a predetermined position and deliver a distance signal to the electronic control module 52 via a first communication line 59. The actuator 51 is biased toward the second position by a spring 60. The actuator 51 position may be infinitely varied between the first and second position. The position sensor 58 as illustrated is an ultrasonic position sensor. The ultrasonic position sensor 58 sends a signal toward a target and receives the signal after it is reflected off of the target. The amount of time required to receive the reflected signal is used to determine position. Numerous other position sensors 58 may be substituted including, hall effect, inductive and linear variable differential transformers.

As is well known in the art, the desired pressure in the high pressure rail 14 is generally a function of the engine's operating condition. For instance, at high speeds and loads, the rail pressure is generally desired to be significantly higher that the desired rail pressure when the engine 12 is operating at an idle condition. For example, the desired rail pressure may vary from 4 mega-pascal at idle to 30 mega-pascal at full load. An operating condition sensor 62 is attached to an electronic control module 52 via a second communication line 66. The operating condition sensor 62 provides the electronic control module 52 data, which includes engine speed and load conditions. In addition, a pressure sensor 68 periodically provides the electronic control module 52 with the actual fluid pressure in the high pressure rail 14 via a third communication line 72. The electronic control module 52 compares a desired rail pressure, which is a function of engine operating condition, with the actual rail pressure provided by pressure sensor 68.

A temperature sensor 76 may additionally be connected to the fluid actuated system 10, preferably between the pump and drain passage 28. The temperature sensor 76 is adapted to provide data related to fluid temperature to the electronic control module 52 via a fourth communication line 78. The temperature sensor 76 is also of typical construction and will not be discussed in detail. The temperature sensor 76, as with all other sensors, may provide either an analog or digital signal.

Industrial Applicability

In operation of the present invention, the electronic control module 52 monitors the pressure sensor 68, operating condition sensor 62, position sensor 58 and the temperature sensor 76. If the desired and actual rail pressures are different, the electronic control module 52 further evaluates the position of the actuator 51. If desired pressure is above actual pressure and the actuator 51 is at the first position, the electronic control module 52 maintains actuator 51 position. If the desired pressure is above actual and the actuator 51 is between the first and second position, the electronic control module 52 sends a control signal to the actuator 51 to cause movement toward the first position.

If the desired pressure is below actual and the actuator 51 is between the first and second position, the electronic control module 52 sends a move signal to the actuator 51 commanding movement toward the second position. If the desired pressure is below actual and the actuator 51 is at the second position, the electronic control module 52 maintains actuator 51 position.

To increase accuracy of pressure control, the electronic control module 52 may be programmed with a number of maps. The maps can be created through experimentation and relate to a number of variables of the fluid actuated system 10. Examples of maps that may be desirable are hereafter described. (1) Change in rail pressure related to actuator position and engine/pump speed. (2) Change in fluid pressure related to rate of actuator movement. (3) Rate of actuator movement related fluid temperature. (4) Fluid viscosity related to fluid temperature and rate of actuator movement. A number of other maps using position and temperature data may be utilized to more accurately control the fluid actuated system 10.

The above description is intended for illustrative purposes only, and is not intended to limit the scope of the present invention in any way. Those skilled in the art will appreciate that various modifications can be made without departing from the spirit and scope of the present invention, which is defined in the terms of the claims set forth below.

What is claimed is:

1. A fluid actuated system comprising:

a variable delivery pump having a piston and a high pressure conduit, an actuator having a plunger, moveable between a first position at which a maximum fluid output being delivered and a second position at which a minimum fluid output being delivered, a position sensor connected to said pump and being adapted to deliver a signal relative to the position of the actuator between said first and second position;

a fluid pressure sensor connected to said high pressure conduit and being adapted to deliver a pressure signal representative of a fluid pressure in said high pressure conduit; and an electronic control module connected to receive said pressure signal and said position signal, and delivering a first directional move signal in response to said pressure signal being below a first predetermined value and said actuator being at a location between said first and second positions, said actuator receiving said first directional move signal and moving said plunger in a first direction toward maximum fluid output.

2. The fluid actuated system of claim 1, said electronic control module receiving said pressure signal and position signal, and delivering a second directional move signal, opposite of said first directional move signal, in response to said pressure signal being above a second predetermined value and position signal being between said first and second position, said actuator receiving said second move signal and moving said plunger toward minimum fluid output.

3. The fluid actuated system of claim 1 wherein said electronic control module being connected to deliver a hold signal to said actuator in response to said pressure signal approaching said first or second predetermined value at a predetermined rate.

4. The fluid actuated system claim 1 wherein said electronic control module is adapted to deliver a hold signal to said actuator in response to said fluid pressure being below a predetermined value and said actuator being at said first position.

5. The fluid actuated system of claim 1 wherein said electronic control module is adapted to deliver a hold signal in response to said fluid pressure signal being above said predetermined pressure and said position signal being at said second position.

6. The fluid actuated system of claim 1 wherein said electronic control module is adapted to calculate a speed of said actuator based on the amount of time required to move said actuator between a first position and a second position.

7. The fluid actuated system of claim 1 wherein said pump is a fixed displacement variable delivery type of pump.

8. The fluid actuated system of claim 1 wherein said variable delivery pump includes a variable angle swash plate.

9. The fluid actuated system of claim 1 wherein said position sensor is a linear position sensor.

10. The fluid actuated system of claim 1 including a temperature sensor connected to said high pressure, said temperature sensor being adapted to deliver a signal related to a fluid temperature, and said electronic control module being adapted to determine fluid viscosity based on said fluid temperature and said actuator speed.

11. A method of controlling a fluid pump, said fluid pump having an actuator, said actuator being moveable between a first position at which said pump delivering a maximum fluid output, and a second position at which said pump delivering a minimum fluid output, said method including the steps of:

sensing the pressure of said fluid output and delivering a pressure signal;

sensing the position of said actuator and delivering a first position signal related to a maximum pump output and second position signal related to a minimum pump output; and delivering first directional move signal in response to said pressure signal being below a predetermined value and said position signal being between said first and second position, and delivering a second directional move signal in response to said pressure signal being above said predetermined value and said position signal being between said first and second position.

12. The method of claim 11 including the step of sensing a temperature of said fluid and delivering a responsive temperature signal.

13. The method of claim 12 including the step of determining fluid viscosity.

14. The method of claim 12 including the step of altering a set of control parameters based on fluid viscosity.

15. A method of estimating the viscosity of a fluid in a hydraulically actuated system having a fluid delivery pump comprising the steps of:

sensing a first position of a moveable device within said fluid and delivering a responsive position signal;

delivering a first directional move signal to said moveable device and sensing a second position at a predetermined time;

calculating a speed of said moveable device; and determining the viscosity of said fluid based upon said calculated speed.

16. The method of claim 15 including the step of sensing a temperature of a fluid and delivering a temperature signal, and determining the viscosity based upon said speed and said temperature signal.

* * * * *